United States Patent [19]

Krohne et al.

[11] Patent Number: 4,586,889

[45] Date of Patent: May 6, 1986

[54] CONCRETE-FINISHING MACHINE

[75] Inventors: Albert W. Krohne, 506 Hanover St., Okawville, Ill. 62271; Wallace Luebke, Okawville, Ill.

[73] Assignee: Albert W. Krohne, Okawville, Ill.

[21] Appl. No.: 528,418

[22] Filed: Sep. 1, 1983

[51] Int. Cl.[4] ..... E01C 19/30

[52] U.S. Cl. ..... 425/456; 249/219 R; 404/96; 404/114; 404/119; 404/120; 425/63

[58] Field of Search ..... 425/456, 218, 63; 404/93, 96, 119, 120, 114, 118; 249/219 R; 105/149

[56] References Cited

U.S. PATENT DOCUMENTS

| | | | |
|---|---|---|---|
| 967,714 | 8/1910 | Blome et al. | 404/93 |
| 1,887,341 | 11/1932 | Venable | 404/96 |
| 1,973,885 | 9/1934 | Rasmussen | 404/106 |
| 2,094,910 | 10/1937 | Baily | 404/96 |
| 2,219,246 | 10/1940 | Jackson | 404/114 |
| 3,005,387 | 10/1961 | Heltzel et al. | 404/120 |
| 3,164,072 | 1/1965 | Blankenship et al. | 404/96 |
| 3,217,621 | 11/1965 | Kubala | 404/114 |
| 3,220,322 | 11/1965 | Lewis | 404/114 |
| 3,294,001 | 12/1966 | Thomson | 404/96 |
| 3,299,786 | 1/1967 | Godbersen | 404/96 |
| 3,368,466 | 2/1968 | Rowe | 404/119 |
| 3,516,340 | 6/1970 | Perkins | 404/93 |
| 3,874,806 | 4/1975 | Grist et al. | 404/93 |
| 4,316,715 | 2/1982 | Allen | 425/456 |
| 4,318,631 | 3/1982 | Vickers | 404/93 |
| 4,412,803 | 11/1983 | Allen | 425/456 |
| 4,427,358 | 1/1984 | Stilwell | 404/119 |
| 4,466,757 | 8/1984 | Allen | 404/114 |

FOREIGN PATENT DOCUMENTS 0065681 12/1982 European Pat. Off. ..... 404/133

*Primary Examiner*—Jay H. Woo
*Assistant Examiner*—James C. Housel

[57] ABSTRACT

A concrete-finishing machine has a drive horse, a slave horse, and a bridge-like truss selectively connectable to, or separable from, those horses at different levels so those horses can roll along surfaces at the same level or at distinctly-different levels. Vertically-directed jacks can dispose a screed or a float at different distances below the level of the bridge-like truss, and that screed and that float can be shifted along the length of that bridge-like truss to avoid obstructions within the area to be concreted. Those jacks can set different sections of the screed at different levels and thereafter simultaneously move all sections of that screed up or down. Interacting surfaces on the jacks and on the bridge-like truss enable those jacks to be readily secured to or separated from that bridge-like truss. The bridge-like truss can consist of a single short, intermediate length or long section, or can consist of various numbers of short, intermediate length and long sections which are so rigidly interconnected that workmen can use that bridge-like truss as a bridge to cross over areas to be concreted and also can sit on the midpoint of that bridge-like truss to work on the concrete without causing appreciable deflection, even where the bridge-like truss is forty feet long. Aligning and coupling members interconnect adjacent sections of the bridge-like truss, and also protect the ends of those sections during the storage and shipment of those sections by projecting outwardly beyond the ends of those sections.

3 Claims, 22 Drawing Figures

20
21
240
217
204
276
227
211
213
215
224
278
223
282
284
286
218
280
290
292
221
186
172
182
176
225
226
220
222
219
216
296
294
233
235
402
400
426
440
434
432
416
418
420
422
424
438
446
410
406
428
444
442
430
436
448
412
404
408
414

CONCRETE-FINISHING MACHINE

SUMMARY OF THE INVENTION

The present invention provides a concrete-finishing machine which has a motor-driven, wheeled support that is referred to as a drive horse, has a further wheeled support that is referred to as a slave horse, and that is spaced laterally from the drive horse, has a bridge-like truss that is releasably securable to the drive horse and to the slave horse to interconnect those horses for conjoint movement, and has a shaft that is supported by the bridge-like truss and that transmits power from the drive horse to the slave horse. By being separable from each other, the horses and the bridge-like truss can be transported more readily than would be the case if they were permanently connected, and they can be moved through areas which are not sufficiently unobstructed to permit the interconnected horses and bridge-like truss to pass. It is, therefore, an object of the present invention to provide a concrete-finishing machine which has a bridge-like truss that is releasably securable to a drive horse and a slave horse to move as a unit.

The bridge-like truss can consist of a single short section, can consist of a single long section, or can consist of a desired combination of short sections or of long sections or of short and long sections that are releasably secured to each other in end-to-end relation. Each section of one group of sections is four feet long, each section of another group of sections is six feet long, each section of yet another group of sections is eight feet long, each section of a further group of sections is ten feet long, and each section of a still further group of sections is twenty feet long. By appropriately selecting the sections to be used for any given bridge-like truss, it is possible to provide a concrete-finishing machine which has any desired length, in two foot increments, from four feet to forty feet. It is, therefore, an object of the present invention to provide a concrete-finishing machine which has a bridge-like truss that can consist of a single short section, can consist of a single long section, or can consist of a desired combination of short sections or of long sections or of short and long sections that are releasably secured to each other in end-to-end relation.

The various sections of any given bridge-like truss can be connected to, or separated from, each other without any need of tools. Yet, whenever those sections are connected to each other, they coact to make that bridge-like truss sturdy and free of all "play". Also, that bridge-like truss can be connected to, or separated from, the drive and slave horses without any need of tools. Yet, whenever that bridge-like truss is connected to those horses, a concrete-finishing machine is provided that is sturdy and free of all "play". Clamps are used to releasably but solidly clamp the various sections of the bridge-like truss to each other, and further clamps are used to releasably but solidly clamp that bridge-like truss to those horses; and those clamps can be set and released without any need of tools. It is, therefore, an object of the present invention to provide a concrete-finishing machine wherein clamps are used to releasably but solidly clamp the various sections of a bridge-like truss together without any need of tools, and wherein further clamps are used to releasably but solidly clamp that bridge-like truss to drive and slave horses without any need of tools.

The bridge-like truss which is connectable to, and which can span the distance between, the horses is so sturdy that it can be used as a bridge to cross the area which is being concreted. That bridge-like truss preferably is so sturdy that it will permit a heavy man—weighing up to two hundred pounds—to sit in the middle thereof without causing a deflection greater than one-half of an inch, even where that bridge-like truss is forty feet long. In such event, a worker can use that bridge-like truss to reach, and to work on, places which are close to the middle of the area being concreted. Such places can be the areas adjacent a drain, a female coupling, a base for a lamppost or any other base. It is, therefore, an object of the present invention to provide a bridge-like truss which is sectional in nature, which is connectable to and which can span the distance between two horses, and which is sturdy enough to be used as a bridge by a workman wishing to cross a concreted area or to finish portions of that area which are spaced inwardly from the sides of that area.

The concrete-finishing machine provided by the present invention has a screed which can strike off and level newly-cast concrete; and the length of that screed will be shorter than, but will be a function of, the length of the bridge-like truss. In addition, that concrete-finishing machine has a float which can provide a smooth finish for the surface of the screeded concrete; and the length of that float will be shorter than, but will be a function of, the length of the bridge-like truss. That screed and that float can each consist of a single short section, can each consist of a single long section, or can each consist of a desired combination of short sections or of long sections or of short and long sections that are disposed adjacent to each other in end-to-end relation. Abutting sections of the screed will be held in intimate end-to-end relation with the abutting lower faces thereof at the same level; and, similarly, abutting sections of the float will be held in intimate end-to-end relation with the abutting lower faces thereof at the same level. As a result, even a plural-section screed can provide a surface which simulates a surface that would be provided by a single section screed; and even a plural-section float can provide a surface which simulates a surface that would be provided by a single section float. It is, therefore, an object of the present invention to provide a concrete-finishing machine which has a screed and also has a float—each of which can consist of a single short section, can consist of a single long section, or can consist of a desired combination of short sections or of long sections or of short and long sections that are disposed adjacent to each other in end-to-end relation.

The concrete-finishing machine provided by the present invention can dispose various sections of the screed at different inclinations and/or levels, and also can dispose various sections of the float at different inclinations and/or levels. As a result, that concrete-finishing machine can provide a plural-section screed and a plural-section float, can dispose various sections of the screed at different inclinations and/or levels, and also can dispose various sections of the float at different inclinations and/or levels.

The various sections of the plural-section screed and float are held by vertically-directed jacks that are supported by the bridge-like truss. Those jacks are adjustable independently of each other to provide desired inclinations and elevations for the various sections of the screed and for the various sections of the float; but those jacks also are ajustable in unison so the screed or the float can be raised or lowered as a unit. This is desirable, because it enables different sections of the screed and different sections of the float to be set at different inclinations and at different levels, and then permits the screed or float to be raised or lowered without changing any of the relative inclinations or relative levels of the sections of that screed or float. It is, therefore, an object of the present invention to provide a concrete-finishing machine which has various sections of the plural-section screed and float thereof held by vertically-directed jacks that are supported by the bridge-like truss and that are adjustable independently of each other but that also are adjustable in unison.

The concrete-finishing machine of the present invention provides jacks that are securable to, and separable from, the bridge-like truss of that concrete-finishing machine without any need of tools. As a result, those jacks facilitate the assembling and disassembling of that concrete-finishing machine, and also facilitate the addition or removal of a screed or a float to that concrete-finishing machine. It is, therefore, an object of the present invention to provide a concrete-finishing machine which has jacks that are securable to, and separable from, the bridge-like truss of that concrete-finishing machine without any need of tools.

The concrete-finishing machine of the present invention mounts the screed and the float therefor so that screed and float can be shifted lengthwise of the bridge-like truss of that concrete-finishing machine. The resulting shifting of that screed and float makes it possible to finish concrete where vertical obstructions at, or in, one edge or both edges of the concreted area would prevent unswerving forward movement of that screed or float. It is, therefore, an object of the present invention to provide a concrete-finishing machine which mounts the screed and the float therefor so that screed and float can be shifted lengthwise of the bridge-like truss of the concrete-finishing machine.

The lengthwise shifting of the screed and float of the present invention is accomplished with ease, because that float and screed are held by jacks which are securable to the bridge-like truss of the concrete-finishing machine by rollers. Those rollers enable those jacks, and hence the screed and float, to be shifted lengthwise of that bridge-like truss at any time and with little effort. As a result, an end of the screed or float can be made to closely follow the configuration of any obstruction within the space at one side of the area to be concreted. It is, therefore, an object of the present invention to provide a concrete-finishing machine with rollers that hold vertically-acting jacks which support a screed and float and that are securable to, but can roll along, the bridge-like truss of that concrete-finishing machine.

Most job sites, where concrete is to be poured and finished, have open spaces on opposite sides of the areas to be concreted. At such job sites, the wheeled supports can roll along those open spaces or can roll along guide rails resting on those open spaces. However, some job sites have open spaces at just one side thereof because space and structure limitations either fill, or interrupt, the spaces at the opposite side of the areas to be concreted; and still other job sites have space and structure limitations which either fill, or interrupt, the spaces at both sides of the areas to be concreted. Most concrete-finishing machines can not be used at such job sites. The concrete-finishing machine of the present invention can, however, be used on a job site where space and structural limitations either fill, or interrupt, the space at one side or at both sides of the area to be concreted, and also can be used on a job site where open spaces are available on both sides of the area to be concreted. It is, therefore, an object of the present invention to provide a concrete-finishing machine which can be used to finish concrete on a job site where space or structural limitations either fill, or interrupt, the space at one side or at both sides of the area to be concreted, and also can be used at a job site where open spaces are available on both sides of the area to be concreted.

Where a job site has space or structural limitations that either fill, or interrupt, the space at one side or both sides of the area to be concreted, vertically-directed columns, posts, studs or the like will be present, or can be provided, adjacent that one side or adjacent both sides of that area. Brackets can be secured to those columns, posts, studs or the like to support a rail or a pair of rails above the level of the area to be concreted; and the concrete-finishing machine of the present invention can be arranged so one set of the horses thereof can roll along the one rail or each set of horses thereof can roll along one of the pair of rails. As a result, that concrete-finishing machine can be used at a job site which has space or structural limitations that either fill, or interrupt, the space at one side or both sides of the area to be concreted. It is, therefore, an object of the present invention to provide a concrete-finishing machine which can be arranged to have one set of the horses thereof roll along a rail or which can have each set of horses thereof roll along one of a pair of rails, supported by brackets that are secured to columns, posts, studs or the like adjacent one side or both sides of the area to be concreted.

The screed and float of the concrete-finishing machine of the present invention can extend under the rail or rails supported on the brackets that are secured to the columns, posts, studs or the like adjacent one side or both sides of the area to be concreted. As a result, that screed and float can strike off and smooth concrete which is beneath that rail or those rails. It is, therefore, an object of the present invention to provide a concrete-finishing machine that has the screed and float thereof extendable under the rail or rails supported on brackets that are secured to columns, posts, studs or the like adjacent one side or both sides of the area to be concreted.

Whenever the concrete-finishing machine of the present invention is to be used at a job site which has open spaces on opposite sides of the area to be concreted, or is to be used at a job site which has rails that are supported on brackets that are secured to walls, columns, posts, studs or the like adjacent the opposite sides of the area to be concreted, points on the bridge-like truss which are in vertical registry with each other will be secured to the horses, so that bridge-like truss will be substantially horizontal. Whenever that concrete-finishing machine is to be used at a job site where just one of the horses must roll along a rail which is supported on brackets that are secured to columns, posts, studs or the like adjacent one side of the area to be concreted, points on the bridge-like truss which are vertically displaced will be secured to the horses, so that bridge-like truss will be substantially horizontal. The present invention makes it possible for points on the bridge-like truss that are in vertical registry, or that are vertically displaced, to be selectively secured to the horses by making that bridge-like truss and those horses so the bottoms of the ends of that bridge-like truss can be secured to those horses, so the tops of the ends of that bridge-like truss can be secured to those horses, or so the bottom of one end of that bridge-like truss can be secured to one horse and the top of the other end can be secured to the other horse. It is, therefore, an object of the present invention to provide a concrete-finishing machine which has a bridge-like truss that can have the bottoms of the ends thereof securable to the horses of that concrete-finishing machine, can have the tops of the ends thereof securable to the horses of that concrete-finishing machine, or can have the bottom of one end thereof secured to one horse and can have the top of the other end thereof secured to the other horse.

Other and further objects and advantages of the present invention should become apparent from an examination of the drawing and accompanying description.

In the drawing and accompanying description, a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing, FIG. 17 is a perspective view, on a scale that is intermediate those of FIGS. 2 and 12, which shows one end of a float and part of one of the supports therefor, FIG. 18 is a sectional view, on the scale of FIG. 17, which is taken along a plane indicated by a line 18—18 in FIG. 17.

DETAILED DESCRIPTION OF PREFERRED EMBODIMENT

Figures 1, 7, 8, 9, 10:
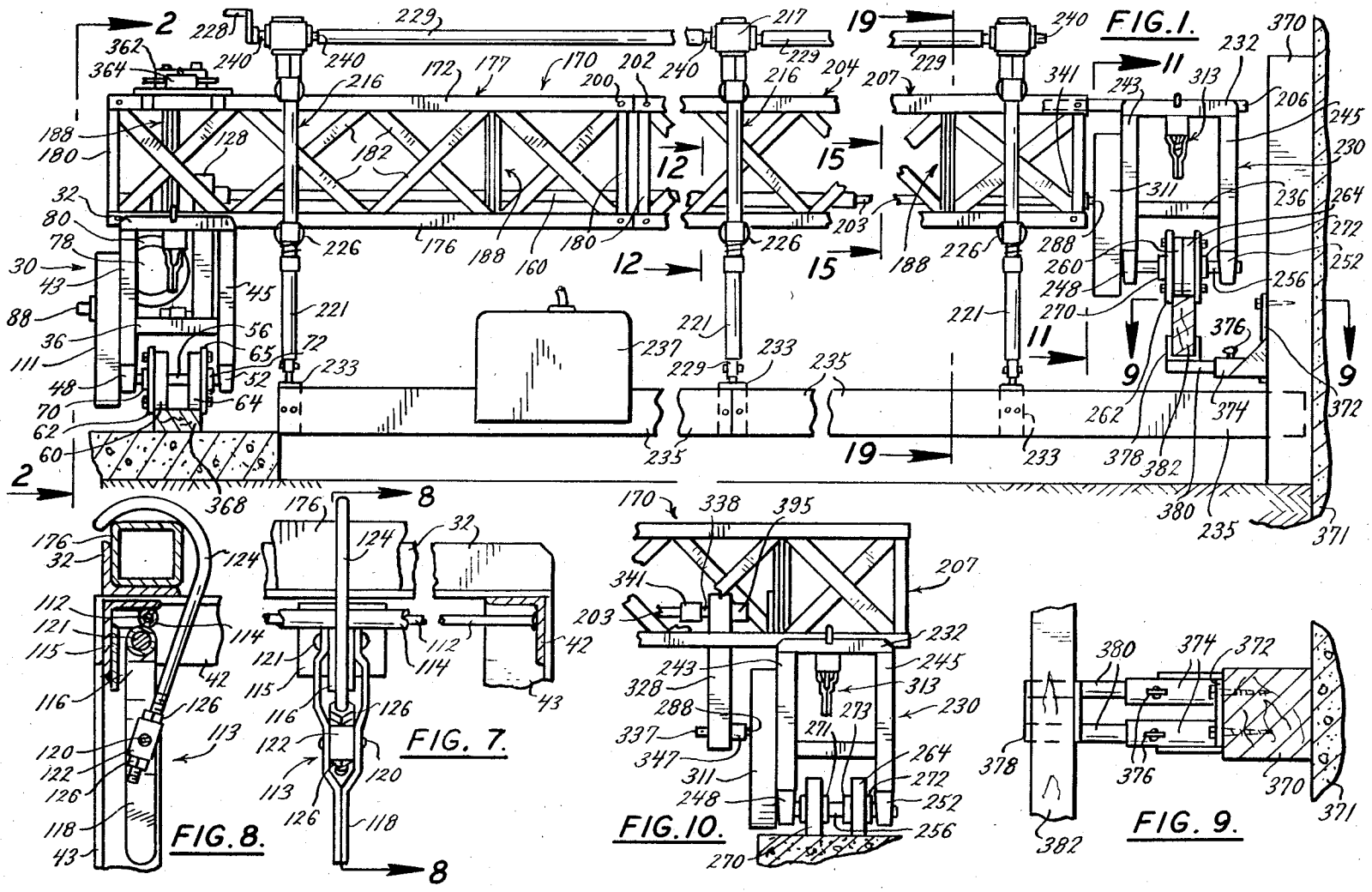
FIG. 1 is a broken, front elevational view of one preferred embodiment of concrete-finishing machine that is provided by the present invention.
FIG. 7 is a broken, front elevational view of the bridge-like truss and one of the horses of the embodiment of FIG. 1, which is on the scale of FIG. 6 and which is taken along a plane indicated by a line 7—7 in FIG. 4.
FIG. 8 is a sectional view, on the scale of FIG. 6, which is taken along a plane indicated by a line 8—8 in FIG. 7.
FIG. 9 is a broken, sectional view, on the scale of FIG. 6, which is taken along a plane indicated by a line 9—9 in FIG. 1.
FIG. 10 is a front elevational view of a portion of the embodiment of FIG. 1 wherein the bottom, rather than the top, of the right-hand end of the bridge-like truss is secured to the right-hand horse.

Referring to the drawing in detail, the numeral 30 generally denotes a horse whose principal frame members are shown in FIGS. 1-4 and include horizontally-disposed, laterally-directed angles 32 and 34 at the top thereof, horizontally-disposed, transversely-directed angles 36 and 38 which are in register with, but below the levels of, the angles 32 and 34, horizontally-disposed, longitudinally-directed angles 40 and 42 which underlie and are secured to and support the angles 32 and 34, horizontally-disposed, longitudinally-extending channels 44 and 46 which underlie and are secured to and support the angles 36 and 38, and vertically-directed angles 43, 45, 47 and 49 which are adjacent the corners of that horse and which interconnect the various horizontally-disposed angles with the channels 44 and 46. Those various angles and channels, plus other frame members that are not shown, make the horse 30 sturdy and rugged.

Bearing housings 48 and 50 are secured to the lower web of channel 46, and bearing housings 52 and 54 are secured to the lower web of channel 44; and bearings in those bearing housings rotatably support shafts 56 and 58. A wheel 60, with a removable flange 62, is mounted on the shaft 56; and a similar wheel 64, with a removable flange 65, also is mounted on that shaft. Positioning guides 70 and 72 are disposed on that shaft, outwardly of those wheels, to keep the confronting faces of those wheels closer together than the width of a wooden rail 368 which is disposed adjacent one side of the area to be concreted, as shown by FIG. 1. The positioning guides 70 and 72 are spaced far enough apart to permit the wheels 60 and 64 to move far enough along the shaft 56 to follow any variations of the edges of the rail 368 which may deviate from a straight line; but those positioning guides are close enough to each other to keep the rims of those wheels from slipping off of that rail. Wheels 66 and 68, which preferably are identical to the wheels 62 and 64, are mounted on the shaft 58; and positioning guides 74 and 76 are mounted on the shaft 58 outwardly of those wheels.

Figure 2:
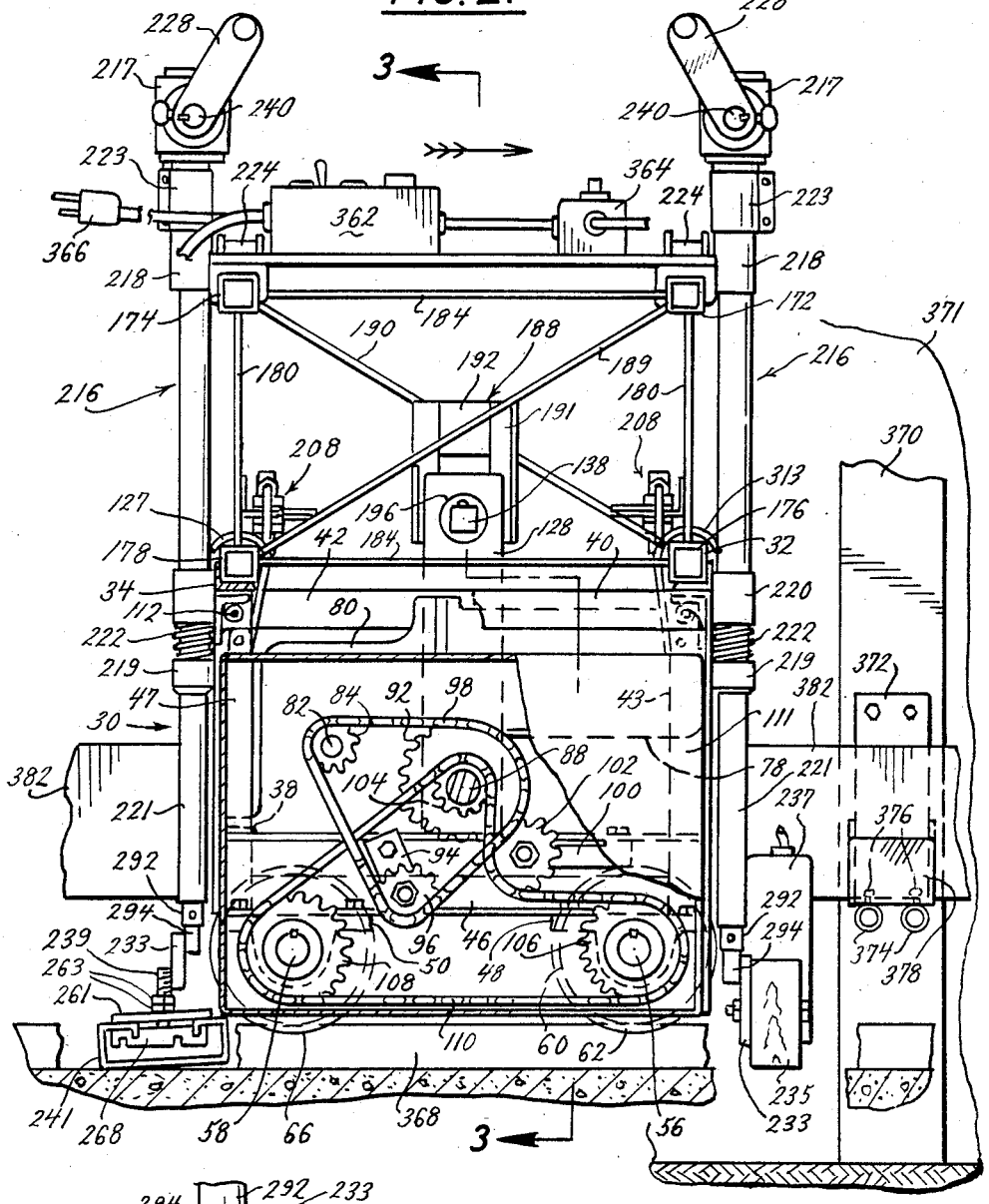
FIG. 2 is a partially broken away view, on a larger scale, which is taken along a plane indicated by a line 2—2 in FIG. 1.
Figures 3, 4, 5, 6:
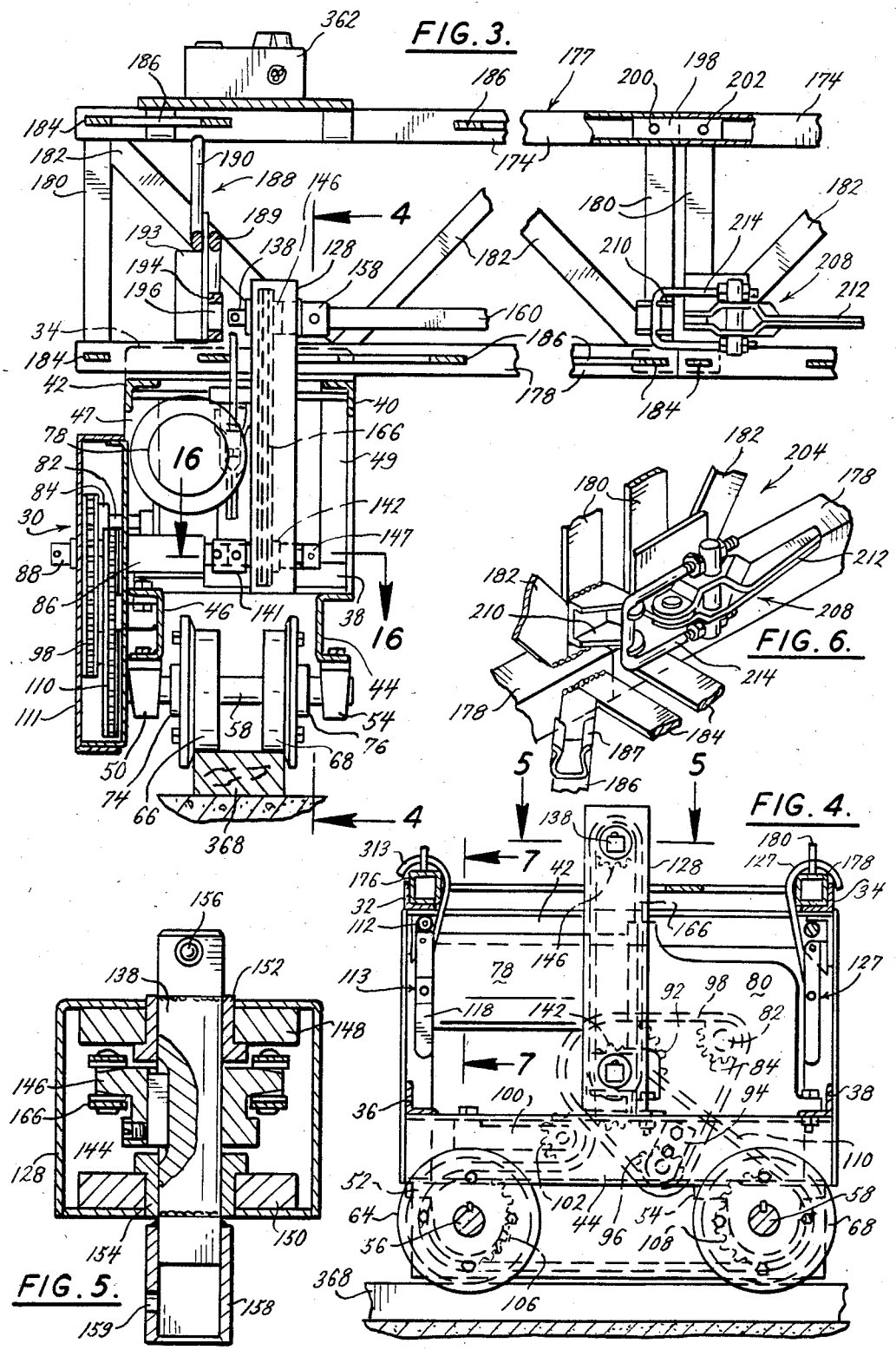
FIG. 3 is a sectional view, on the scale of FIG. 2, which is taken along a broken plane indicated by a broken line 3—3 in FIG. 2.
FIG. 4 is a sectional view, on the scale of FIG. 2, which is taken along a plane indicated by a line 4—4 in FIG. 3.
FIG. 5 is a sectional view, on a still larger scale, which is taken along a plane indicated by a line 5—5 in FIG. 4.
FIG. 6 is a perspective view, on a scale intermediate those of FIGS. 2 and 5, of abutting portions of two adjacent sections of the bridge-like truss of the embodiment of FIG. 1 and of a readily-openable clamp which releasably secures those adjacent sections to each other.
Figures 11, 12, 13, 14, 15, 16:
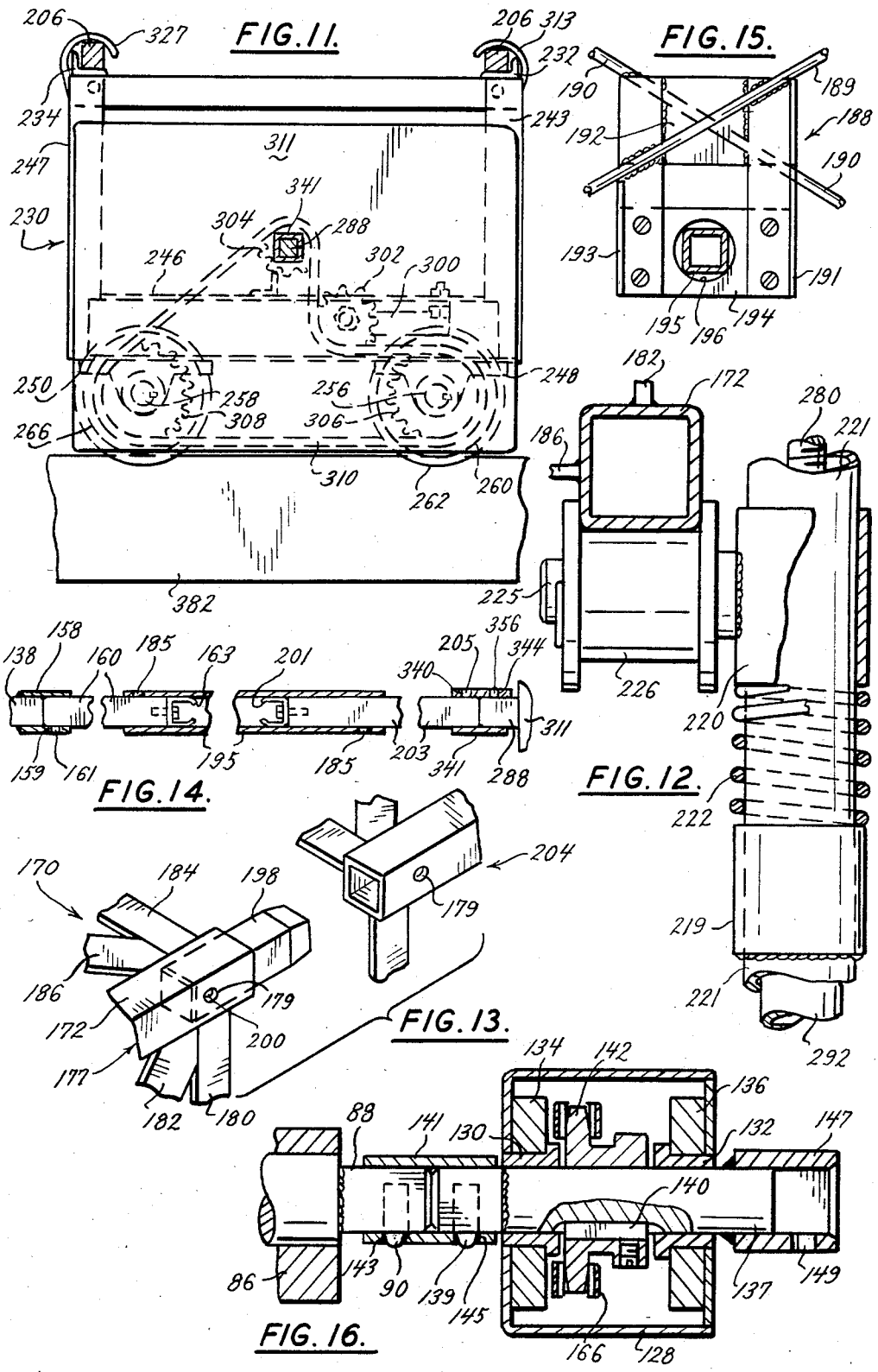
FIG. 11 is a sectional view, on the scale of FIG. 2, which is taken along a plane indicated by a line 11—11 in FIG. 1.
FIG. 12 is a sectional view, on a very large scale, which is taken along a plane indicated by a line 12—12 in FIG. 1.
FIG. 13 is a broken perspective view, on the scale of FIG. 6, which shows two further abutting portions of two adjacent sections of the bridge-like truss of the embodiment of FIG. 1 as they are spaced apart but are in register with each other.
FIG. 14 is a broken vertical section, on a scale intermediate those of FIGS. 2 and 12, through sections of the connecting shaft of the embodiment of FIG. 1.
FIG. 15 is a sectional view, on a scale close to that of FIG. 14, which is taken along a plane indicated by a line 15—15 in FIG. 1.
FIG. 16 is a sectional view, on a scale which is larger than that of FIG. 14, which is taken along a plane indicated by a line 16—16 in FIG. 3.

The numeral 78 in FIG. 4 denotes an electric motor which is bolted to a gear housing 80; and that gear housing is bolted to the angle 38 and to a further angle, not shown, which extends between the channels 44 and 46 of the horse 30. Although different motors could be used, a constant torque, adjustable speed 2Z846 motor of the Dayton Manufacturing Company has been found to be usable. The gear housing 80 is of standard and usual construction; and the output shaft 82 of that gear housing has a sprocket pinion 84 thereon, as shown by FIGS. 2–4. A horizontally-disposed, transversely-directed bearing block 86, which is shown by FIGS. 3 and 16, rotatably supports a shaft 88 that has a square right-hand end. The other end of that shaft supports a sprocket pinion 104, as shown by FIG. 2. A button-type, spring-biased detent 90 is mounted within a recess in the right-hand end of shaft 88, as shown particularly by FIG. 16.

A sprocket gear 92 is mounted on the left-hand end of shaft 88 so it is positioned outwardly of the sprocket pinion 104; and the sprocket gear 92 is in register with the sprocket pinion 84 on the output shaft 82 of gear housing 80. An idler bracket 94 is secured to the channel 46; and it holds an idler sprocket pinion 96 in register with sprocket pinion 84 and sprocket gear 92. A sprocket chain 98 passes around, and meshes with, the teeth of sprocket pinions 84 and 96 and sprocket gear 92. An idler bracket 100 is secured to a frame member, not shown, of the horse 30 adjacent the channel 46; and that bracket holds an idler sprocket pinion 102 in register with the sprocket pinion 104, and also with a sprocket gear 106 that is secured to the shaft 56 and a sprocket gear 108 that is secured to the shaft 58. A sprocket chain 110 passes around, and meshes with, the teeth of sprocket pinions 102 and 104 and of sprocket gears 106 and 108.

The output shaft 82 of gear housing 80 can be rotated in either direction by motor 78 and the gears within the gear housing; and hence that shaft can act through sprocket pinions 84 and 96, sprocket gear 92 and sprocket chain 98 to drive the shaft 88 in the clockwise or counterclockwise direction. The latter shaft can act through sprocket pinions 102 and 104, sprocket gears 106 and 108 and sprocket chain 110 to drive the horse 30 to the right or to the left in FIG. 2. The numeral 111 denotes a housing which encloses the sprocket pinions and gears and chains 84, 92, 96, 98, 102, 104, 106, 108 and 110. As shown by FIGS. 1 and 3, the outer end of shaft 88 extends through, and beyond, the housing 111.

The numeral 112 in FIGS. 7 and 8 denotes an elongated rod which has one end thereof welded to the vertically-directed angle 43, and which has the other end thereof, not shown, welded to the vertically-directed angle 45. A sleeve 114, which is part of a toggle clamp 113, is telescoped over the elongated rod 112. An ear 116, which is part of that clamp, is secured to an angle 115 of that clamp; and that angle is fixedly secured to the sleeve 14, as shown by FIG. 8. That ear supports a pivot 121; and a further pivot 120 of that clamp rotatably supports a block 122 which has a hook 124; and the threaded shank of that hook is adjustable secured to that block by nuts 126. A handle 118 of that clamp, which has the upper end thereof rotatably held by the pivot 121, has the pivot 120 secured adjacent its approximate midpoint. Various readily-openable clamps could be used as the clamp 113; but the Model 351 Toggle Clamp of the De-Sta-Co. has been found to be very usable. The numeral 127 denotes a readily-openable clamp, which preferably will be identical to the clamp 113 but which is mounted adjacent the angle 34 of the horse 30.

The numeral 128 denotes a housing for a transmission which has bearings 130 and 132 held by bearing blocks 134 and 136 adjacent the lower end of that housing, as shown by FIG. 16. That housing has bearings 152 and 154 held by bearing blocks 148 and 150 adjacent the upper end thereof, as shown by FIG. 5. A shaft 137, which has a keyway therein, is rotatably supported by the bearings 130 and 132; and the projecting ends of that shaft are square. A shaft 138, which has a keyway therein, is rotatably supported by the bearings 152 and 154; and the projecting ends of that shaft are square. A button-type spring-biased detent 139 is mounted within a recess in one end of the shaft 137; and a square socket 147 is fixedly secured to the other end of the shaft 137, as shown by FIG. 16. That socket has a hole 149 therein. A key 140 is disposed within the keyway in the shaft 137; and that key and a set screw secure a sprocket pinion 142 to that shaft. A sleeve 141, which has holes 143 and 145 therein, is dimensioned to telescope over, and to interconnect, the confronting ends of shafts 88 and 137, as shown by FIG. 16. The button 90 of shaft 88 lodges within the hole 143 of sleeve 141; and the button 139 of shaft 137 lodges within the hole 145 in that sleeve.

A key 144 is disposed within the keyway in shaft 138, as shown by FIG. 5; and that key and a set screw secure a sprocket pinion 146 to the shaft 138. A button-like, spring-biased detent 156 is provided at one end of the shaft 138; and a square socket 158 is fixedly secured to the other end of that shaft. That socket has a hole 159 therein. A sprocket chain 166 passes around, and meshes with, the teeth of the sprocket pinions 142 and 146.

A solid shaft 160, of square cross section, has one end thereof telescoped into the socket 158; and a button-type, spring-biased detent 161, in a recess in that end of that shaft, fits into the hole 159 of that socket. The other end of shaft 160 is telescoped into one end of a hollow shaft 195, of square cross section, as shown by FIG. 14. A generally U-shaped clip 163 is fixedly secured to that other end of shaft 160; and that clip is resilient so it can be compressed to fit together within the hollow shaft 195. However, that clip will apply frictional forces to the inner surface of that hollow shaft which are large enough to prevent accidental shifting of shaft 195 relative to shaft 160.

The other end of the hollow shaft 195 has one end of a solid shaft 203, of square cross section, telescoped within it. A generally U-shaped clip 201 is fixedly secured to that end of shaft 203; and that clip is resilient so it can be compressed to fit within the hollow shaft 195. However, that clip will apply frictional forces to the inner surface of that hollow shaft which are large enough to prevent accidental shifting of shaft 195 relative to shaft 203. A button-type, spring-biased detent 205, in a recess in the other end of shaft 203, fits into a hole 340 in a sleeve 341. A further hole 344 in that sleeve accommodates a button-type, spring-biased detent 356 in a recess in one end of a shaft 288. Each end of the hollow shaft 195 has a hole 185 therein which could accommodate button-type, spring-biased detents such as the button-type, spring-biased detent 356 of shaft 288 or the button-type, spring-biased detent of a short stub shaft, not shown, which could connect one end of the shaft 195 to the socket 158.

The numeral 170 generally denotes a bridge-like truss which may consist of one or more sections; and, in the embodiment shown in the drawing, that truss has three sections 177, 204 and 207. Each section has horizontally-disposed, laterally-directed square tubes 172 and 174 at the top thereof, and has horizontally-disposed, laterally-directed square tubes 176 and 178 at the bottom thereof. Holes 179 are provided adjacent each end of each of those tubes, as shown by FIG. 13. Vertical members 180, which are shown as plates, extend between, and are fixedly secured to, the tubes 174 and 178; and further vertical members 180 extend between, and are fixedly secured to, the tubes 172 and 176. In addition, inclined members 182, which are shown as plates, extend generally vertically between, and are fixedly secured to, the tubes 174 and 178; and further inclined plates 182 extend generally vertically between, and are fixedly secured to the tubes 172 and 176. Horizontally-disposed, longitudinally-directed members 184, which are shown as plates, extend between and are rigidly secured to tubes 172 and 174; and further horizontally-disposed, longitudinally-directed members 184 extend between and are secured to tubes 176 and 178. Horizontally-disposed members 186, which are shown as plates, are inclined to the horizontally-disposed members and extend between, and are secured to, the tubes 172 and 174; and further horizontally-disposed members 186 extend between, and are secured to, the tubes 176 and 178.

In addition, at least two braces 188 are fixedly mounted within each section of the bridge-like truss 170; and each of those braces includes an inclined rod 190 which extends between, and is rigidly secured to, the tubes 174 and 176, and an inclined rod 189 which extends between, and is rigidly secured to, the tubes 172 and 178. An angle 191 is fixedly secured to each of the rods 189 and 190; and an angle 193, which has a portion of the flange thereof cut away, is fixedly secured to each of those rods, as shown by FIGS. 2 and 15. A plate 192 extends between the upper portions of those angles, and a bearing block 194 extends between the lower portions of those angles. That block has a hole 196 therein which is dimensioned to accommodate the hollow shaft 195, and hence also will accommodate the smaller cross-section shaft 160. The block 194 preferably is made from a plastic which has a smooth surface, and which can act as a bearing for the shafts 195 and 160—even though those shafts are square in cross section.

The various tubes, plates and braces of the sections 177, 204 and 207 of the bridge-like truss 170 make those sections extremely sturdy. Four spring clips 187 are fixedly secured to the upper surface of one of the plates 186 which extends between the tubes 176 and 178; and one of those spring clips is shown in FIG. 6.

Those spring clips are provided to hold aligning guides 198 which are dimensioned to telescope easily into the ends of the tubes 172, 174, 176 and 178. Each of those aligning guides has a button-type, spring-biased detent 200 held within a recess in one end thereof, and has a chamfer at the other end thereof, as indicated particularly to FIG. 13. That detent can fit within the hole 179 adjacent one end of one of the tubes of one section of the bridge-like truss while the chamfered end fits into one end of an abutting tube of an adjacent section of that bridge-like truss. The aligning guides hold abutting sections of the bridge-like truss 170 accurately aligned; and they coact with clamps 208—one of which is shown in FIG. 6—to make that bridge-like truss sturdy and rugged and free of all "play". The aligning guides 198 and the clamps 208 are able to make a plural-section bridge-like truss 170 rugged enough and sturdy enough to permit a heavy man—weighing up to two hundred pounds—to sit in the middle thereof without causing a deflection greater than one-half of an inch, even where that bridge-like truss is forty feet long. In such event, a worker can use that bridge-like truss to reach, and to work on, places which are close to the middle of the area being concreted.

Aligning guides 198 will be inserted in each end of each of the tubes 172, 174, 176 and 178 of each section 177, 204 and 207 of the bridge-like truss 170 whenever that section is not in use. Any object which tended to strike one of those ends, during the transporting or storing of a given section, would strike the end of the aligning guide in that end rather than strike the end of the tube; and hence would not deform or burr that end of that tube. As a result, each section will be capable of being coupled to an abutting section when it is delivered to the job site. The aligning guide in any given end of a tube of a section 177, 204 and 207 can be left in position where the end of the abutting tube of an adjacent section is to serve as a female end, and it will be removed where the end of the abutting tube of an adjacent section is to serve as a male end. This means that each aligning guide 198 can be a protector for an end of a tube of a section of the bridge-like truss, can serve as the male end of that tube, or can be removed to make that end a female end.

In the preferred embodiment of the present invention, a plurality of sections for bridge-like trusses 170 will be four feet in length, other sections will be six feet in length, further sections will be eight feet in length, additional sections will be ten feet in length, and still further sections will be twenty feet in length. By using appropriate combinations of those sections, it is possible to provide bridge-like trusses having lengths from four feet to forty feet in two-foot increments. Each bridge-like truss will be sturdy and rugged and will have the abutting tubes of each section thereof fully aligned, whether that bridge-like truss is eight feet long, is forty feet long, or has any desired length between eight and forty feet.

Referring particularly to FIG. 6, the readily-openable toggle clamp 208 has a hook-like portion 210 welded to a vertically-directed member 180 of the truss section 177 and has a hasp-like portion 214 movable relative to the truss section 204. A handle 212 can be rotated in the clockwise direction in FIG. 6 to enable the hasp-like portion 214 to be freed from, or to be moved into engagement with, the hook-like portion 210; but when that handle is in the position shown by FIG. 6, it can hold that hasp-like portion so tightly against that hook-like portion that the adjacent portions of the tubes 178 are rigidly held against end-wise movement relative to each other. Those tubes will be held against sideways movement relative to each other by the coupling guide 198 which is disposed within the ends thereof. As a result, those tubes are solidly held in rigid alignment. Various clamps could be used as the readily-openable toggle clamp 208, but the 341 clamp of De-Sta-Co. has been found to be useful.

The clamp 208 can be set in its clamping position without any need of tools, and it can be set in its releasing position without any need of tools. The other clamps, not shown—which will coact with the clamp 208 to hold the sections 177, 204 and 207 in assembled relation to form the bridge-like truss 170—also can be set in clamping position or releasing position without any need of tools. Yet, those clamps will coact with the clamp 208 to hold the sections 177, 204 and 207 in such solid and intimate engagement that the resulting bridge-like truss will be sturdy and rugged and wholly free of "play".

The numeral 216 generally denotes an elongated, vertically-directed jack which is shown in detail in FIGS. 12 and 19–21. The numeral 217 denotes the housing for a gear box at the top of that jack, and that gear box has a downwardly-directed shaft 276 with a keyway therein, as shown particularly by FIGS. 19 and 20. That gear box has a crank shaft 240, of circular cross section, projecting outwardly from both sides thereof; and a crank 288 is releasably securable to that crank shaft by a "hairpin" which releasably fits into aligned openings in that crank and in that crank shaft. Two chains extend between two hairpins and the gear housing to keep those hairpins from getting lost. Although different gear boxes could be used, the 796, Model M31.1 STAB Gear Housing of the Hub City Company of Aberdeen, S. Dak., has been found to be useful.

The numeral 223 denotes a split sleeve which has the lower end thereof snugly telescoped over a sleeve 218; and the upper end of that split sleeve is dimensioned to snugly telescope over a boss at the lower surface of gear housing 217 through which the output shaft 276 extends. Ears 211 and 213 at opposite sides of the slit in the split sleeve 223 accommodate bolt and nut combinations 227. Those nut and bolt combinations will be loosened to permit the upper end of the split sleeve 223 to be telescoped upwardly over the boss at the bottom of gear housing 218 and to permit the lower end of that split sleeve to be telescoped downwardly over the sleeve 218; and then those nut and bolt combinations will be tightened to hold that split sleeve fixedly secured to that boss and that sleeve.

A plate 282 with a hole therein is welded to the top of sleeve 218; and an elongated lead screw 280 has the upper end thereof journalled in the hole in that plate. A nut 284 is pinned to the upper end of lead screw 280 at a point immediately above the plate 282, and a further nut 286 is pinned to that lead screw immediately below that plate. Those nuts and that plate will prevent endwise shifting of that lead screw relative to the sleeve 218.

Figures 19, 20, 21, 22:
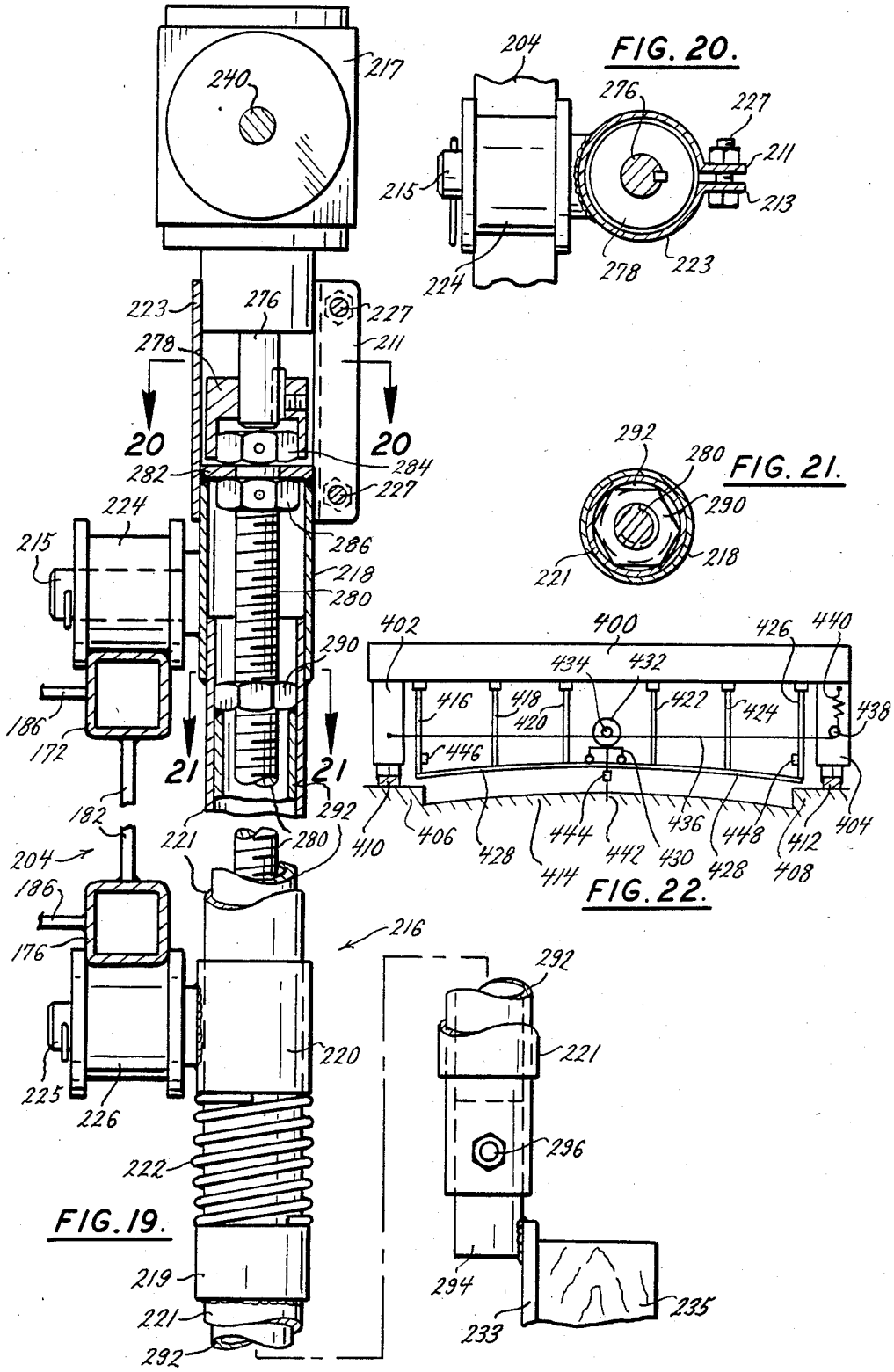
FIG. 19 is an exploded, sectional view, on the scale of FIG. 12, which is taken along a plane indicated by a line 19—19 in FIG. 1.
FIG. 20 is a sectional view, on the scale of FIG. 19, which is taken along a plane indicated by a line 20—20 in FIG. 19.
FIG. 21 is another sectional view, on the scale of FIG. 19, which is taken along a plane indicated by a line 21—21 in FIG. 19.
FIG. 22 is a front elevational, kinematic view of the concrete-finishing machine when it is equipped to form shallow skid-resisting grooves in the surface of the deck of a bridge.

The numeral 221 denotes an elongated sleeve which is fixedly secured to the lower end of the sleeve 218; and hence the split sleeve 223, the sleeve 218, and the sleeve 221 constitute an elongated tubular housing which has a uniform diameter throughout the major portion of the length thereof but which has two progressively-larger diameter sections adjacent the upper end thereof. A sleeve 219 is fixedly secured to the exterior of the tube 221 intermediate the ends of that tube, as shown by FIGS. 12 and 19. A sleeve 220 is mounted on the tube 221 so it can reciprocate relative to that tube. A helical compression spring 222 encircles the tube 221 intermediate the fixed sleeve 219 and the sliding sleeve 220; and that spring biases the sleeve 220 for movement upwardly along the length of the tube 221. A roller 226 is rotatably mounted on a stub shaft 225 which is carried by the sliding sleeve 220. A similar roller 224 is mounted on a stub shaft 215 which is fixedly secured to the sleeve 218; and the roller 224 is above, and in register with, the roller 226.

The numeral 292 denotes a tube which is disposable within, and is readily reciprocable relative to, the tube 221, as shown particularly by FIGS. 12 and 19. A nut 290 is welded to the top of tube 292, and that nut accommodates the thread of lead screw 280. The bottom of tube 292 accommodates the upper end of a cylindrical member 294 which has a flat plate 233 welded to it. A bolt and nut combination 296 releasably secures the upper end of the cylindrical member 294 within the lower end of tube 292.

As shown particularly by FIGS. 1 and 2, the jack 216 is directed vertically. The roller 224 is formed and dimensioned to engage, and to roll along, the upper surface of either of the tubes 172 and 174 of a section of the bridge-like truss 170; and the roller 226 is formed and dimensioned to engage, and to roll along, the bottom face of either of the tubes 176 and 178 of that section. It will be noted, as shown particularly by FIGS. 2, 3 and 13, that the horizontally-disposed members 178, 184 and 186 are spaced inwardly from the upper surfaces of tubes 172 and 174, and also are spaced inwardly from the lower faces of the tubes 176 and 178. As a result, those four tubes are enabled to perform a dual function, namely, strengthen and ridigify each section of the bridge-like truss 170, and also to act as rails along which the rollers 224 and 226 of jack 216 can roll. This means that although that jack will be supported by a section of the bridge-like truss, it can be shifted along the length of that section.

The spring 222 will urge the sleeve 220 and its roller 226 upwardly along the length of the tube 221 to a position which is spaced from the roller 224 a distance that is considerably less than the vertical dimension of any section of the bridge-like truss 170. However, after the roller 224 has been fitted over the top of either of the tubes 172 and 174 of a section of that bridge-like truss, a downward force can be applied to the sleeve 220 to move the roller 226 thereon downwardly below the lower face of tube 176 or tube 178 of that section. While that roller is held in that lower position, it will be moved under the lower face of the tube 176 or 178, and then the downwardly force on that sleeve will be released. Thereupon, the spring 222 will force the roller 226 up into engagement with the lower face of tube 176 and 178; and, thereafter, the force of that spring will hold the jack 216 against accidental separation from that section of the bridge-like truss 170. The force which is exerted by the spring 222 will resist, but will not prevent, rolling of the rollers 224 and 226 along the surfaces of tubes 172 and 176 or of tubes 174 and 178. As indicated by FIG. 1, a number of jacks can be used with the bridge-like truss 170. A minimum of two jacks must be used to support the screed 235, and a minimum of two jacks must be used to support the float 241. It is desirable to use enough jacks to provide full support for the screed 235 and for the float 241, regardless of the lengths and profiles of that screed and float.

The numeral 230 generally denotes a slave horse which, in combination with the drive horse 30 and the bridge-like truss 170, constitute the basic structural sections of the concrete-finishing machine of the present invention. Many of the components of the slave horse 230 are identical to components of the drive horse 30—except for being denoted by numerals which are two hundred higher than the numerals which are used to denote the corresponding components of the drive horse 30. Thus, the slave horse 230 has horizontally-disposed angles 232, 234, 236, vertically-directed angles 243, 245 and 247, a channel 246, bearing housings 248, 250, and 252, shafts 256 and 258, a wheel 260 with a flange 262, and wheels 264 and 266. Positioning guides 270 and 272 are mounted on the shaft 256 outwardly of the wheels 260 and 264, as shown by FIGS. 1 and 10.

In addition, positioning guides 271 and 273 can be mounted on the shaft 256, as shown by FIG. 10, to limit the movement of the wheels 260 and 264 toward each other. Those additional positioning guides are not required for the shaft 56 or the shaft 256 in FIGS. 1 and 11; because the wheels 60 and 64 of drive horse 30 are held apart by the engagement of the rims 62 and 65 thereon with opposite sides of the rail 368, and the confronting faces of the wheels 260 and 264 of the slave horse 230 are in abutting engagement. A rail 382, which preferably is a length of lumber held on its edge, underlies and supports the wheels 260 and 264 of the slave horse 230 in FIGS. 1 and 11. However, in FIG. 10, the flanges 262 and 265 have been removed so the wheels 260 and 264 can roll on a flat surface; and hence the positioning guides 271 and 273 are used.

The numeral 311 denotes a housing for the sprocket pinions and gears and chains of the slave horse 230; and that housing will generally resemble, but will be shallower than, the housing 111 of the drive horse 30. The housing 311 can be shallower than the housing 111 because the slave horse 230 does not have the sprocket pinions 84 and 96, the sprocket wheel 92 or the sprocket chain 98. Instead, the housing 311 merely encloses part of the shaft 288, a sprocket pinion 304 which is mounted on that shaft, an idler bracket 300, an idler sprocket pinion 302, sprocket wheels 306 and 308, and a sprocket chain 310, all as shown by FIG. 11.

FIGS. 11 and 14 show the projecting end of shaft 288 fitting into one end of the sleeve 341; and the other end of that sleeve accommodates the end of the shaft 203, as shown by FIGS. 10 and 14. As a result, energization of the motor 78 in the desired direction will cause the output shaft 82 of gear housing 80 to act, via sprocket pinion 84, idler sprocket pinion 96, sprocket wheel 92 and sprocket chain 98 to rotate the shaft 88; and that shaft will, via sprocket pinion 104, idler sprocket pinion 102, sprocket gears 106 and 108 and sprocket chain 110, cause the drive horse 30 to move in the desired direction. In addition, the shaft 88 will, via the sprocket pinions 142 and 146 and the sprocket chain 166 of the transmission within the housing 128, rotate the shafts 160, 195, 203 and 288—with consequent movement of the slave horse 230 in the desired direction via sprocket pinion 304, idler sprocket pinion 302 and sprocket wheels 306 and 308. In this way, the drive horse and the slave horse will move in unison and will thereby provide the desired movement for the bridge-like truss 170.

The numeral 370 in FIGS. 1 and 2 denotes a post, stud or pole of a structure which is to be equipped with a concrete floor; and that post, stud or pole will be one of a number of generally-aligned posts, studs or poles which are secured to, and which extend inwardly from, the wall 371 of a building. Brackets 372, which have horizontally-directed sleeves 374 extending inwardly therefrom, are secured to the posts, studs or poles 370 by lag screws. Wing-type set screws 376 are provided for the sleeves 374; and those set screws can hold the rods 380 of a U-shaped support 378. The rods 380 can be telescoped outwardly relative to the sleeves 374 to whatever extent is required to provide alignment of the various U-shaped supports 378 of the brackets 372 which are secured to the faces of the posts, studs, or poles 370. The adjustability which is provided by the rods 380 and sleeves 374 is very desirable; because the posts, studs or poles in barns and other agricultural structures frequently are not aligned precisely.

As shown particularly by FIGS. 1 and 2, the brackets 372 are spaced far enough above the area which is to be concreted to enable a screed 235 to move wholly below all portions of that bracket. That screed will be made in sections; and each section preferably will be a timber which is secured to two or more of the plates 233 so it is held on end, as shown particularly by FIG. 2. The ends of the various sections of the screed 235 will abut each other; and the abutting ends will have the lower edges thereof at the same level. One or more vibrators 237 of standard and usual design will be secured to the screed 235 to apply vibratory motion to that screed as the concrete-finishing machine moves across the surface of the newly poured concrete.

A set of jacks 216 also is provided to support a float which is generally denoted by the numeral 241 and which includes a channel with upstanding flanges 249 that have inturned lips 251 with downwardly-bent edges 253. A block 255, which is shown by FIGS. 17 and 18, has elongated grooves 257 in the upper edge thereof that extend lengthwise of that block. That block also has a deeper groove 259 adjacent one edge thereof; and that deeper groove parallels the grooves 257. When the innermost groove 257 and the groove 259 are telescoped upwardly over the downwardly-bent edges 253, the lower surface of the float 241 will be set at an angle relative to the block 255, as shown by FIG. 18. However, if desired, the two left-hand most grooves 257 could be set in engagement with the downwardly bent edges 253 of the float 241; and, at such a time, the bottom surface of that float would be parallel to the block 255.

The numeral 261 denotes a plate which loosely fits a bolt 239 that snugly fits within an opening in the block 255, and which has the upper end thereof welded to a plate 233. Nuts 263 can be moved along the length of the bolt 239 to enable the plate 261 to be moved upwardly away from the in turned lips 251 of the float 241 whenever it is desired to shift the position of the downturned edges 253 relative to the grooves in the top of the block 255. The plate 233 will be secured to the vertically-reciprocal tube 292 of a jack 216 at the trailing side of the concrete-finishing machine, whereas the plates 233 which support the sections of the screed 235 will be secured to the lower ends of the vertically-reciprocal sleeves 292 of jacks 216 at the leading side of that concrete-finishing machine.

An alternate form of grooved block is denoted by the numeral 268, and it is shown in FIG. 2. Instead of having all of the grooves in the upper face thereof, as does the block 255 of FIGS. 17 and 18, the block 268 has two equal-depth grooves in one face thereof, and has the unequal depth grooves in the other face thereof. When the equal-depth grooves of block 268 are caused to telescope upwardly over the downwardly-bent edges 253, the lower surface of the float 241 will be horizontal, and hence will be parallel to that block. However, when the unequal depth grooves of block 268 are caused to telescope upwardly over the downwardly-bent edges 253, the lower surface of the float 241 will be set at an angle relative to that block.

The numeral 206 denotes rod-like extensions of square cross section which have button-like, spring-biased detents disposed within recesses adjacent the ends thereof. The inner ends of those extensions can extend into the open ends of the upper tubes of the section 207 of the bridge-like truss 170, as shown at the right-hand side of FIG. 1. Those detents will fit into the holes adjacent the ends of those tubes to enable those extensions to serve as integral parts of the bridge-like truss 170. The extensions 206 will overlie, and are supported by, the angles 232 and 234 of the slave horse 230, as indicated by FIGS. 1 and 11. Readily-openable toggle clamps 313 and 327, which preferably will be identical to the readily-openable toggle clamps 113 that are shown in detail by FIGS. 7 and 8, will secure the extensions 206 to the angles 232 and 234 of the slave horse 230. As a result, the drive horse 30, the bridge-like truss 170 and its extensions 206, and the slave horse 230 will be able to move as a unit.

The numeral 362 in FIGS. 1 and 2 denotes a control box which contains a D.C. rectifier, an on-off switch, and a motor speed control. That control box will be of standard and usual design. The numeral 364 denotes a switch housing and a switch which can be selectively actuated to supply power to the one or more vibrators 237 which are mounted on the screed 235. The number 366 denotes a plug which can be inserted in the female plug of a suitable extension cord.

In using the concrete-finishing machine in the manner which is shown by FIG. 1, the left-hand ends of the tubes 176 and 178 of section 177 of bridge-like truss 170 will be secured to the angles 32 and 34 of drive horse 30 by clamps 113 and 127, the extensions 206 will have the inner ends thereof inserted in the right-hand ends of the tubes 172 and 174 of the section 207 of the bridge-like truss 170, and then those extensions will be disposed atop, and will be solidly clamped to, the angles 232 and 234 of the slave horse 230. Thereafter, the abutting wheels 260 and 264 and the wheel 266 and its counterpart of that slave horse will be lifted up and rested on the top of the rail 382; and the wheels 60, 64, 66 and 68 of drive horse 30 will be set in position atop the rail 368. Each of the jacks 216 at the front of the bridge-like truss 170 will be adjusted to dispose the plate 233 at the bottom thereof at the desired height relative to that bridge-like truss. Where the surface of the concrete is to be perfectly flat, all of those plates will be set at the same level. However, if the concrete surface is to have one or more inclined portions, the plates 233 at the opposite ends of those inclined portions will be set at different, predetermined levels to set the ends of the various sections of screed 235 at desired predetermined levels. Once the gear housings 217 of the individual jacks 216 have been individually actuated by the crank 228 to effect the desired positioning of the plates 233 of those jacks, the short crank shafts 240 of all of those jacks will be interconnected by elongated shafts 229 which will telescope over the ends of the crank shafts 240. The hairpins that are attached to the gear housings 217 will seat in aligned openings in those short crank shafts and in those elongated shafts to force all of those shafts to rotate as one continuous shaft. The jacks 216 can be shifted along the upper surfaces of tubes 172 and 174 and along the lower surfaces of tubes 176 and 178 to enable the ends of the elongated shafts 229 to be telescoped over the ends of the crank shafts 240. Subsequent rotation of the crank 228 will then cause all of the rotable members of all of the gear housings 217 of all of the jacks 216 at the front of the bridge-like truss 170 to rotate together, and will thereby effect simultaneous raising or lowering of all of the plates 233. In that way, the present invention makes it easy to provide the exact vertical positioning of each of the plates 233 for the jacks 216 at the front of the bridge-like truss 170, and then subsequently cause all of those plates to move upwardly or downwardly in unison while maintaining the exact same vertical positions relative to each other.

Similarly, the gear housings 217 of the jacks 216 at the rear of the bridge-like truss 170 will be adjusted individually to set the plates 233 at the bottoms of those jacks at the exact desired relative vertical positions. Thereafter, the elongated shafts 229 can be used to interconnect the short shafts 240 of those gear housings; and subsequent rotation of the crank 228 will cause all of the plates 233 of those jacks to move upwardly or downwardly in unison while maintaining the exact same vertical positions relative to each other.

By appropriate individual positioning of the plates 233 at the front of the bridge-like truss 170 and by corresponding individual positioning of the plates 233 at the rear of that bridge-like truss, it is possible to provide any desired slopes or angular relationships for the surface of the concrete. If arcuate surface areas were desired, the bottoms of the sections of the screed 235 could be appropriately cut to provide those arcuate surface areas. Similarly, the bottoms of the sections of the float could be bent to have arcuate configurations that would provide those desired arcuate surface areas.

After the concrete is poured in FIG. 1, the crank 228 for the jacks 216 at the rear of the bridge-like truss 170 will be actuated to raise the floats 241 well above the desired level of the concrete. However, the crank for the jacks 216 at the front of that bridge-like truss will be actuated to set the bottoms of the various sections of the screed 235 at the desired levels.

The control box 362 then will be actuated to cause the concrete-finishing machine to move toward and over the concrete at the desired speed. The right-hand end of the right-hand most section of the screed 235 will be set immediately adjacent the inner surface of the wall 371. As the concrete-finishing machine causes that right-hand most section of that screeed to approach any of the posts, studs or poles 370 of the building, the operator of that concrete-finishing machine will pull on one of the jacks 216 at the front face of the bridge-like truss 170. Thereupon, the screed 235 will cause all of the jacks 216 to shift along that bridge-like truss away from the wall 371 until that screed just clears that post, stud or pole. Immediately after that right-hand end has cleared that post, stud or pole, a push will be applied to the left-hand most jack 216 at the front of the bridge-like truss to cause the screed 235 to again have the right-hand end of its right-hand most section immediately adjacent the inner surface of the wall 371.

Because the rail 382 is spaced above the level of the concrete a distance which is greater than the height of the screed 235, that screed can strike off the concrete which directly underlies the slave horse 230. In fact, as shown by FIG. 1, that screed can strike off concrete which is disposed to the right of that slave horse. As a result, the concrete-finishing machine is able to screed concrete which extends outwardly beyond one end of the concrete-finishing machine.

The screed 235 can be successively set at different levels as the concrete-finishing machine is recurrently moved lengthwise along the rails 368 and 382. In that way, the desired level and kind of surface can easily be provided for the concrete.

Subsequently, the crank handle 228 for the jacks 216 at the front of the bridge-like truss 170 will be actuated to raise the screed 235 well above the level of the surface of the concrete. Thereafter, the crank 228 for the jacks 216 at the rear of that bridge-like truss will be actuated to dispose the trailing edge of the float 241 so it will engage and smooth the surface of the concrete. As the concrete-finishing machine moves along the rails 368 and 382, the right end of the right-handmost section of the float 241 will approach one of the posts, studs or poles 370 of the building; and, thereupon, the operator of that concrete-finishing machine will pull on the jack 216 closest to the drive horse 30. The other jacks 216 and the entire length of the float 241 will shift far enough away from the wall 371 to enable the right end of the right-hand section of that float to clear the post, stud or pole 370. Immediately thereafter, an inwardly-directed push will be applied to that jack to cause the right end of the right-handmost section of the float 241 to again approach the inner surface of the wall 371.

The crank 228 for the jacks 216 at the rear of the bridge-like truss 170 will be actuated to raise the float 241 whenever the concrete-finishing machine is moved in the rearward direction prior to a further forwardly-directed pass over the concrete. Prior to that forwardly-directed pass, the crank 228 will be actuated to set the rear edge of the float 241 at the desired level relative to the surface of the concrete.

A comparison of FIGS. 1 and 10 shows that a transmission is not used adjacent the slave horse 230 in FIG. 1 but is used adjacent that slave horse in FIG. 10. Because the extensions 206 hold the tubes 172 and 174 of the section 207 of the bridge-like truss 170 at the level of the angles 232 and 234 of the slave horse 230 in FIG. 1, the shaft 203 can, via the sleeve 341, be directly connected to the input shaft 288 of the slave horse 230. In FIG. 10, however, where the slave horse 230 is to roll on the ground rather than on an elevated rail 382, the bottom tubes 176 and 178 of the section 207 of the bridge-like truss 170 will rest upon the angles 232 and 234 of that slave horse. Consequently, a transmission within a housing 328 will be needed to transmit power from the shaft 203 to the input shaft 288 of the slave horse 230; and that transmission preferably will be identical to the transmission within the housing 128. The same or another sleeve 341 will telescope over the shaft 338 at the top of the transmission to accommodate one end of the shaft 203. A socket 347, which is on the shaft 337 at the bottom of the transmission in housing 328, and which is similar to the socket 147 in FIG. 16, will telescope over the input shaft 288 of the slave horse 230.

The transmissions which are used with the concrete-finishing machine of the present invention will extend up into the bridge-like truss 170, as indicated by FIGS. 1 and 10. The transmission within the housing 128 will extend downwardly into the space between the vertically-directed angles of the drive horse 30; but the transmission within the housing 328 will be disposed outwardly of the slave horse 230. The engagements between the button-like detents in the various shafts 88, 137, 138, 338, 337 and 288 and the holes in the sleeves 141 and 341 and in the sockets 147, 158 and 347 are sufficient to maintain the two transmissions in position. As a result, there is no need to provide additional support for those transmissions.

The drive horse 30 can be used at either end of the bridge-like truss 170, and it can be set so its housing 111 will be at the left or the right thereof; because the shaft 138 projects outwardly beyond both sides of the housing 128, as shown by FIG. 5. Similarly, the slave horse 230 can be used at either end of the bridge-like truss 170, and it can be set so its housing 311 will be at the left or the right thereof when that slave horse is at the same level as the drive horse; because the shaft 338 projects outwardly beyond both sides of the housing 328. Consequently, the concrete-finishing machine of the present invention is very versatile and useful.

FIGS. 1 and 10 variously show that the wheels of the drive and slave horses can be used on a guide rail such as 368 which is disposed so it is wider than it is high, can be used on a guide rail such as 382 which is disposed to it is taller than it is wide, and can be used on a flat surface. Also, whereas FIGS. 1 and 9 show the posts 370 to be square in cross section, those posts could be round, arcuate or polygonal in cross section, as long as the brackets 371 can be solidly secured to them. Moreover, in the event the posts 370 were of concrete or metal, suitable clamps or fasteners could be used to secure those brackets to those posts.

Where a single-section shaft extends between the socket 158 of the transmission in housing 128 and the shaft 288 of slave horse 230, that shaft will preferably be like the shaft 160 and will have its right-hand end fitted into the sleeve 341. Where a two-section shaft extends between the socket 158 of the transmission in housing 128 and the shaft 288 of slave horse 230, that shaft will preferably be like shafts 160 and 195; and the right-hand end of shaft 195 will fit over the shaft 288. Where a four-section shaft extends between the socket 158 of the transmission in housing 128 and the shaft 288 of slave horse 230, that shaft will consist of a shaft 160, a shaft 195, a shaft 203 and a further shaft 195; and the right-hand end of the further shaft 196 will fit over the shaft 288.

Where a single-section shaft extends between the socket 158 of the transmission in housing 128 and the shaft 338 of the transmission in housing 328, that single-section shaft will preferably be like the shaft 160 and will have its right-hand end fitted into the sleeve 341 on shaft 338. Where a two-section shaft extends between the socket 158 of the transmission in housing 128 and the shaft 338 of the transmission in housing 328, that shaft will preferably be like shafts 160 and 195; and the right-hand end of the shaft 195 will fit over the shaft 338. Where a four-section shaft extends between the socket 158 of the transmission in housing 128 and the shaft 338 of the transmission in housing 328, that four-section shaft will preferably consist of a shaft 160, a shaft 195, a shaft 203 and a further shaft 195 in tandem; and the right-hand end of the further shaft 195 will fit over the shaft 338.

The drive horse 30, the slave horse 230 and the bridge-like truss 170 are securable to, and separable from, each other without any need of tools. Also, the transmission in the housing 328 is securable to, and separable from, the slave horse 230 without any need of tools. Further, the various shafts 160, 195 and 203 are securable to, and separable from, each other and the drive and slave horses 30 and 230 without any need of tools. Consequently, those horses and the bridge-like truss 170 can easily be separated so they can be transported more readily than they could be if they were permanently connected.

Each of the screed 235 and the float 241 can consist of a single short section, can consist of a single long section, or can consist of a desired combination of short sections or of long sections or of short and long sections that are disposed adjacent to each other in end-to-end relation. Abutting sections of the screed 235 will be held in intimate end-to-end relation with the abutting lower faces thereof at the same level by the jacks 216 at the front of the bridge-like truss 170; and, similarly, abutting sections of the float 241 will be held in intimate end-to-end relation with the abutting lower faces thereof at the same level by the jacks 216 at the rear of that bridge-like truss. As a result, even a plural-section screed can provide a surface which simulates a surface that would be provided with a single section screed; and even a plural-section float can provide a surface which simulates a surface that would be provided by a single section float.

The tubes 172, 174, 176 and 178 of the various sections of the bridge-like truss 170 have been shown and described as being square in cross section. However, if desired, those tubes could have round, polygonal or other useful cross sections.

FIGS. 1, 2 and 9 show a wall 371 and an inwardly-extending post, stud or pole 370 adjacent one side of an area to be concreted, and also show the opposite side of that area open. In some instances, as where the area to be concreted is a floor of a building, that area may have walls at each side thereof so neither the drive horse nor the slave horse could be supported by an elongated wooden rail such as the rail 368 in FIGS. 1–4. In that event brackets, similar to the bracket 372, could be secured to the inner surfaces of those walls in the same manner in which the bracket 372 is secured to the post, stud or pole 370 in FIGS. 1, 2 and 9. U-shaped supports and rods, similar to the supports 378 and rods 380 of FIGS. 1, 2 and 9, could then coact with those brackets and with wooden rails such as the rail 382, to support the drive horse as well as the slave horse above the level of the area to be concreted.

The screed or the finishing member would be disposed below the level of, and would extend laterally outwardly beyond, the wheels of those horses; and hence that screed and finishing member would be able to provide screeding and finishing of substantially the entire length and width of the concrete in that area.

If the walls, at each side of the area to be concreted, were free of posts, studs, or poles, the screed and finishing member could have lengths which were just slightly shorter than the shortest straight-line distance between the inner faces of those walls. However, if the inner face of either or both of those walls had one or more inwardly-extending posts, studs, or poles, the screed and the finishing member would have to be made short enough to pass by those posts, studs, and poles. If none of the posts, studs and poles were in register with each other, the screed and the finishing member could be made long enough so one end thereof would be immediately adjacent the inner face of one wall while the other end thereof was immediately adjacent the inner face of a post, stud, or pole at the inner face of the other wall. Where that was done, the entire surface of the concrete in the area to be concreted could be screeded and finished by making two passes during the screeding operation and two passes during the finishing operation—the screed or finishing member having one end thereof immediately adjacent the inner face of one wall during one pass except when it had to be moved outwardly to move around a post, stud or pole; and the other end of that screed or finishing member having the other end thereof immediately adjacent the inner face of the other wall during the second pass except when that other end had to be moved outwardly to move around a post, stud or pole. Even where two or more posts, studs and poles at opposite faces of confronting walls were in register with each other, all portions of the surface of the area to be concreted could be screeded and finished during two screeding passes and two finishing passes over that surface. During one pass, one end of the screed or finishing member would be immediately adjacent the inner face of one wall except when it had to be moved outwardly to move around a post, stud or pole; and, during a further pass, the other end of that screed or finishing member would be immediately adjacent the inner face of the other wall except when it had to be moved outwardly to move around a post, stud or pole. In these various ways, the concrete-finishing machine of the present invention can easily, quickly and precisely screed and finish the entire surfaces of concreted areas—even where those areas have walls immediately adjacent the sides thereof, and even where posts, studs or poles extend inwardly from one or both of those walls.

Referring particularly to FIG. 22, the numeral 400 denotes a bridge-like truss that can, and preferably will, be identical to the bridge-like truss 170. The numeral 402 denotes a horse which can, and preferably will, be identical to the horse 30; and the numeral 404 denotes a horse which can, and preferably will, be identical to the horse 230. The bridge-like truss 400 can, and preferably will, be secured to the horses 402 and 404 in the same manner in which the bridge-like truss 170 is secured to the horses 30 and 230.

The numeral 406 denotes a sidewalk at one side of a section 414 of the deck of a bridge; and the numeral 408 denotes a sidewalk at the other side of that section. The numeral 410 denotes an elongated wooden rail which can, and preferably will, be identical to the wooden rail 368; and the numeral 412 denotes a similar elongated wooden rail. The elongated wooden rails 410 and 412 are set so they are parallel to the sidewalks 406 and 408.

The section 414 is shown in FIG. 22 as having been poured, and then screeded and finished preparatory to having a multiplicity of shallow and narrow grooves formed in the surface thereof. That section could, and preferably will, be screeded and finished by screeds and finishing members which are held below the level of the bridge-like truss 400 by a group of jack-tube combinations that can, and preferably will, be substantially identical to the jack 217 and the combination of tubes shown in FIG. 19. The numerals 416, 418, 420, 422, 424 and 426 denote six jack-tube combinations which are mounted at the front of the bridge-like truss 400; and a further group of six jack-tube combinations will be mounted at the rear edge of that bridge-like truss.

One difference between the jack-tube combinations of FIG. 22 and the jack-tube combination of FIG. 19 is that the jack-tube combinations of FIG. 22 are secured to the bridge-like truss 400 so they will not roll along that bridge-like truss. Those jack-tube combinations will be secured to the bridge-like truss 400 so they will remain fixed relative, to, and will move as a unit with, that bridge-like truss. Similarly, the six jack-tube combinations at the rear of the bridge-like truss 400 will be secured to that bridge-like truss so they will not roll along that bridge-like truss. Further, instead of having a tube 294, a plate 233 and a screed plate 235 secured to the lower end thereof, as does the jack-tube combination of FIG. 19, each of the jack-tube combinations 416, 418, 420, 422, 424 and 426 has a bracket, not shown, which extends rearwardly to underlie and support part of the length of an elongated tubular member 428. The further set of jack-tube combinations at the rear of the bridge-like truss 400 is not equipped with tubes 292, plates 233, bolts 239 and finishing members 241, as is the jack-tube combination at the left-hand side of FIG. 2, but is equipped with brackets, not shown, which extend forwardly to underlie and support parts of the length of an elongated tubular member which is identical to, and which is a counterpart of, the elongated tubular member 428. Those elongated tubular members will be made in sections; and hence can be made longer or shorter as required by the width of the section of the deck which is to be provided with shallow and narrow anti-skid grooves.

FIG. 22 shows a very pronounced crown on the section 414 of the deck of the bridge; and the various jack-tube combinations at the front and rear of the bridge-like truss 400 have been adjusted to provide a similar configuration for the elongated tubular member 428 and its counterpart. As a result, the distances between any points on the surface of the section 414 and the corresponding points on the upper surfaces of the tubular member 428 and of its counterpart will be uniform throughout the length and width of that section.

The numeral 430 denotes a cart which has wheels with concave faces; and those wheels rest upon, and are guided and supported by, the upper surfaces of the elongated tubular member 428 and its counterpart. An electric motor 432 is fixedly mounted on that cart; and a suitable flexible power cord, not shown, extends from that motor to an electric outlet on the horse 402 or on the horse 404. That motor is a reversible motor so it can rotate the output shaft of that motor in either direction.

A wide-faced pulley 434 is mounted on that output shaft; and that pulley accommodates one turn of an elongated cable 436 which has one end thereof secured to the horse 402. The other end of that cable extends around a pulley 438, which is rotatably mounted on the horse 404, and is connected to the lower end of a helical extension spring 440. The other end of that helical extension spring is secured to the horse 404; and that spring will hold the cable 436 taut, and will thereby prevent slippage between that cable and the pulley 434.

A tining tool 442 is held in position below the cart 430 by a vertically-adjustable support 444. That support will force the tool 442 to move with the cart 430; but it can be adjusted to permit the tines of that tool to be set at different, desired distances below the upper surface of the elongated tubular member 428 and of its counterpart. The tines of that tool will be wide enough to form grooves that are one-eighth of an inch wide, those tines will be on one-half inch centers, and those tines will usually extend downwardly far enough into the surface of the concrete of section 414 to make the grooves three-sixteenths of an inch depth.

The numeral 446 denotes a limit switch which is supported adjacent the lower end of the tube of the jack-tube combination 416. That limit switch will be engaged by a projection which extends upwardly from the cart 430 when the tining tool 442 is immediately adjacent the curb for the sidewalk 406. The numeral 448 denotes a limit switch which is secured adjacent the lower end of the tube of the jack-tube combination 426. That limit switch will be engaged by a further abutment on the cart 430 when the tining tool 442 is adjacent the curb for the sidewalk 408.

In using the structure of FIG. 22, the various jack-tube combinations at the front and rear of the bridge-like truss 400 will be adjusted individually to make the elongated tubular member 428 and its counterpart have profiles that are exactly the same as the profile of the section 414. Also, the lengths of the elongated tubular member 428 and its counterpart will be made long enough so the cart 430 can alternately move the tining tool 442 close to the curb of the sidewalk 406 or close to the curb for the sidewalk 408. Those jack-tube combinations will be adjusted individually while the elongated tubular member 428 and its counterpart are disposed far enough above the surface of the section 414 to keep the tining tool 442 from engaging that surface.

While the elongated tubular member 428 and its counterpart are still held far enough above the surface of the section 414 to keep the tining tool 442 from engaging the surface of that section, the motor 432 will be energized to rotate the pulley 434 to cause that pulley to interact with the cable 436 to drive the cart 430 toward one or the other of the curbs. Where, as shown by FIG. 22, the profile of the section 414 is not flat, the cable 436 will be forced to assume a constantly-changing configuration that is alinear as the cart 430 moves between those curbs. However, the spring 440 will yield to permit that cable to assume such a configuration.

Once the tining tool 442 has been moved into a position close to the curb for the sidewalk 406, the cranks 228 for the elongated tubular member 428 and its counterpart will be actuated to lower those elongated tubular members until the ends of the tines of the tining tool 442 extend down approximately three-sixteenths of an inch into the finished surface of the section 414. Because the rotation of the crank 228 for the jack-tube combinations at the front of the bridge-like truss 400 will provide simultaneous and equal movements of the lower ends of all of those jack-tube combinations, and because the rotation of the crank 228 for the jack-tube combinations at the rear of that bridge-like truss will provide simultaneous and equal movement of the lower ends of all of those jack-tube combinations, the ends of the tines of the tining tool can be moved downwardly into the concrete of section 414 while maintaining precise parallelism between the surface of the section 414 and the upper surfaces of the elongated tubular member 428 and its counterpart.

Once the tines of the tining tool 442 have penetrated the surface of the section 414 to the desired depth, the rotation of the cranks 228 can be discontinued. The motor 432 will then be energized to rotate the pulley 434 in a direction which will cause the wheeled cart 430 to move along the full lengths of the elongated tubular member 428 and its counterpart. During that movement, the tines of the tining tool 442 will form a set of precisely-parallel, completely-straight, equal-width, and equally-spaced grooves of fixed depth in the surface of section 414. As the appropriate limit switch 446 or 448 is actuated, when the cart 430 approaches the adjacent curb, the motor 432 will automatically become de-energized. Thereupon, the cranks 228 will be actuated to cause the various jack-tube combinations at the front and rear of the bridge-like truss 400 to raise the elongated tubular member 428 and its counterpart. The resulting raising of the tining tool 442 will lift the ends of the tines of that tool wholly above the surface of section 414. At such time, the motor 78 will be energized long enough, and in the appropriate direction, to cause the horses 402 and 404 to move the bridge-like truss 400, and hence the tining tool 442, far enough so the tines of that tool can subsequently be lowered into engagement with the surface of section 414 to provide a further set of precisely-parallel, completelystraight, equal-width, and equally-spaced grooves of fixed depth.

That further set of grooves will be formed by energizing the motor 432 so it rotates the pulley 434 in the opposite direction, and thereby causes the wheeled cart 432 to move along the lengths of the elongated tubular member 428 and its counterpart until the other limit switch is actuated. At such time, the cranks 228 will again be actuated to raise the elongated tubular member 428 and its counterpart to raise the tines of the tining tool 442 wholly above the surface of section 414. A further advancement of the horses 402 and 404 and of the bridge-like truss 400 will dispose that tining tool in register with the next portion of the surface of section 414 which is to be grooved.

In this simple, quick and direct manner, the structure shown in FIG. 22 can provide a succession of sets of precisely-parallel, completely-straight, equal-width, and equally-spaced grooves of fixed depth in the surface of a section of the deck of a bridge—irrespective of the profile of that section. That structure avoids all nonlinearity of grooves which could adversely affect the steering of vehicles; and it avoids all of the variations in anti-skid protection which could result from variations in groove depth, from variations in groove width, and from variations in groove parallelism.

The structure which is shown by FIG. 22 is particularly useful in providing anti-skid protection for the deck of a bridge which has a concrete surface; because that same structure can be used to successively screed that surface, finish that surface, and groove that surface. Moreover, because the same surface profile will be required during the screeding, finishing and grooving operations, the use of the structure of FIG. 22 becomes very economic and efficient—since the adjustments of the various jack-tube combinations relative to each other need only be made once.

By using a heated tining tool 442, the structure of FIG. 22 could be used to form anti-skid grooves in the surface of an asphaltic deck for a bridge. The various jack-tube combinations at the front and rear of the bridge-like truss 400 would be adjusted relative to each other to establish profiles for the elongated tubular member 428 and its counterpart which were identical to the profile of the asphaltic section 414. The heated tining tool would then be successively raised, moved into register with a portion of that section which required grooves, lowered downwardly until the tines thereof extended into that asphaltic surface, and moved transversely of the bridge deck to form a set of precisely-parallel, completely-straight, equal-width, and equally-spaced grooves of fixed depth. Succeeding operations of the structure of FIG. 22 would then produce further sets of precisely-parallel, completely-straight, equal-width, and equally-spaced grooves of fixed depth.

FIG. 22 shows elongated wooden rails 410 and 412 extending, respectively, along the sidewalks 406 and 408. In any instance where sidewalks are not provided on the bridge, but the bridge has a metal rail at each side thereof, the wheels of the horses 402 and 404 can be set to roll on those rails. In such event, the jack-tube combinations at the front and rear of the bridge-like truss 400 will be made long enough to enable them to dispose the tining tool 442 in the surface of the section 414. Also, those jack-tube combinations can be equipped with screeds and with finishing members to enable the concrete-finishing machine to screed and finish, as well as groove, the surface of the section 414 while that machine is supported by the bridge rails.

If desired, the left-hand end of the cable 436 could be secured to various vertically-spaced points on the horse 402, and the pulley 438 could be secured to various vertically-spaced points on the horse 404. With such an arrangement, the wheeled cart 430 could be set adjacent the centers of the elongated tubular member 428 and its counterpart while the left-hand end of cable 436 was secured to the horse 402 and the pulley 438 was secured to the horse 404. That left-hand end would be secured to horse 402 so the portion of cable 436 between the cart 430 and that left-hand end would be as parallel as possible to the adjacent portion of the surface of section 414; and that pulley would be secured to horse 404 so the portion of cable 436 between the cart 430 and that pulley would be as parallel as possible to the adjacent portion of the surface of section 414. In that event, the changes in the configuration of that cable, as the wheeled cart 430 moved from curb to curb, would be minimal.

Whereas the drawing and accompanying description have shown and described a preferred embodiment of the present invention, it should be apparent to those skilled in the art that various changes may be made in the form of the invention without affecting the scope thereof.

What we claim is:

1. A surface-forming machine which comprises a bridge-like truss, wheel-equipped horses that are secured to said bridge-like truss adjacent the ends of said bridge-like truss to support and to move said bridge-like truss, a surface-engaging member, a plurality of adjustable supports which depend downwardly from said bridge-like truss to hold said surface-engaging member at different levels relative to said bridge-like truss to engage the surface of an area to be formed, means selectively disposing one of said horses at substantially the same level as the other of said horses to enable said horses to support and move said bridge-like truss while said horses are at said same level or displacing said one of said horses a substantial vertical distance from the level of said other of said horses to enable said horses to support and move said bridge-like truss while said horses are at substantially-vertically displaced levels, said means including points on said bridge-like truss which are generally at the same level and which are securable to said horses at generally the same distances above the wheels of said horses so said bridge-like truss can be supported and moved by said horses while it is generally horizontal and said horses are at the same level, said means including points on said bridge-like truss which are at different levels and which are securable to said horses at generally the same distances above said wheels of said horses so said bridge-like truss can be supported and moved by said horses while it is generally horizontal and said horses are at different levels, one of said horses being displaced vertically from the other of said horses whenever the space at just one side of said area is filled or obstructed and thereby causes the support for said horses to be at different levels, a supporting rail mounted above the level of said one side of said area to support said one of said horses while permitting said one of said horses to move longitudinally of said area, and horizontally-adjustable brackets secured to uprights to support said supporting rail, said horizontally-adjustable brackets spacing said supporting rail inwardly of the outer face of one of said horses to underlie the wheels of said horse and being horizontally adjustable to hold said supporting rail substantially straight even where said uprights are not in alignment.

2. A surface-forming machine as claimed in claim 1 wherein said one horse can be secured to either end of said bridge-like truss while facing in the same direction, wherein the other of said horses also can be secured to either end of said bridge-like truss while facing in said direction, and wherein said horses can hold said ends of said bridge-like truss at the same or different levels while said horses are facing in said direction.

3. A surface-forming machine which comprises a first wheel-equipped horse, a second wheel-equipped horse which is laterally spaced from but is movable parallel to said first wheel-equipped horse, a bridge-like truss that is secured to, and that extends between, said first wheel-equipped horse and said second wheel-equipped horse to interconnect said first wheel-equipped horse and said second wheel-equipped horse for movement as a unit relative to an area to be formed, an elongated surface-engaging member which is disposable below the level of said bridge-like truss to engage said area, and means for holding said surface-engaging member at a predetermined level below said bridge-like truss, said holding means holding said surface-engaging member so it extends transversely of said area but is moved longitudinally of said area when said horses move said bridge-like truss lengthwise of said area, said holding means permitting said surface-engaging member to be shifted endwise relative to said bridge-like truss to avoid obstructions, but said surface-engaging member having a length which limits endwise movement of said surface-engaging member to a distance which is only a small fraction of the length of said bridge-like truss, said holding means including a plurality of vertically-acting jacks that hold said surface-engaging member parallel to said bridge-like truss and out of register with said horses, whereby said holding means permit said surface-engaging member to be shifted endwise relative to said bridge-like truss to dispose a portion of said surface-engaging member outwardly beyond the wheels of one of said horses.

* * * * *